United States Patent [19]

Laverick

[11] Patent Number: 4,654,762

[45] Date of Patent: Mar. 31, 1987

[54] LIGHT TABLE

[75] Inventor: William J. Laverick, Chula Vista, Calif.

[73] Assignee: Wizer Equipment, Inc., National City, Calif.

[21] Appl. No.: 718,455

[22] Filed: Apr. 1, 1985

[51] Int. Cl.[4] ..... G09F 13/04

[52] U.S. Cl. ..... 362/97; 206/371; 312/231; 108/23; 362/33

[58] Field of Search ..... 312/231, 232, 119; 108/23; 362/97, 33, 220; D6/420; 206/371

[56] References Cited

U.S. PATENT DOCUMENTS

| | | | |
|---|---|---|---|
| D. 262,849 | 2/1982 | Schoenig | D6/420 |
| 1,615,377 | 1/1927 | Guth | 312/232 |
| 2,257,005 | 4/1940 | Grosse | 362/97 |
| 2,701,838 | 8/1952 | Loesch | 362/97 |
| 3,104,492 | 8/1961 | Banks | 108/23 |
| 4,406,368 | 9/1983 | Hermes | 206/371 |

FOREIGN PATENT DOCUMENTS

| | | | |
|---|---|---|---|
| 174679 | 4/1935 | Switzerland | 108/23 |

*Primary Examiner*—William A. Cuchlinski, Jr.
*Assistant Examiner*—D. M. Cox
*Attorney, Agent, or Firm*—Baker, Maxham & Jester

[57] ABSTRACT

A light table for use in tracing drawings, figures and the like includes a molded unitary housing structure forming an open top chamber with a peripheral support frame on which is mounted a transparent planar sheet or panel of glass or similar support material covering the majority of the open top with a tool tray disposed at one end of the housing for containing artists' or draftsmens' tools and instruments, and adjustable legs are positioned at the four corners of the housing and are adjustable to adjust the slope of the table and to define a right or left handed orientation of the table.

11 Claims, 5 Drawing Figures

LIGHT TABLE

BACKGROUND OF THE INVENTION

The present invention relates to graphic artists' and designers' tools and pertains particularly to a light table having a built-in tool holder.

Light tables or boxes having a transparent support surface and a source of light for projecting through the support surface for enabling the tracing of drawings, sketches and the like are well known and widely used by graphic artists and draftsmen. Such devices however are typically a simple light box that is frequently moved from drafting table to drafting table as the need arises.

Draftsmen and graphic artists typically use a wide variety of tools in their work. These tools include various sizes and hardnesses of pencils, various sizes and configurations of pens, various sizes and combinations of colors of markers, inks, tapes, rulers, and various other implements. It is desirable that such tools be ready at hand and in an organized arrangement.

SUMMARY AND OBJECTS OF THE INVENTION

Accordingly, it is the primary object of the present invention to provide an improved light table in combination with an artists' tool holder.

In accordance with the primary aspect of the present invention, a light table is defined by an enclosed housing having a top support surface of a generally planar configuration that is transparent with a light source disposed behind the transparent surface for supporting drawings and the like for tracing, with a tool holder and support tray disposed at one end of the support table and integral therewith for positioning and arranging tools and the like in a handy and convenient arrangement.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
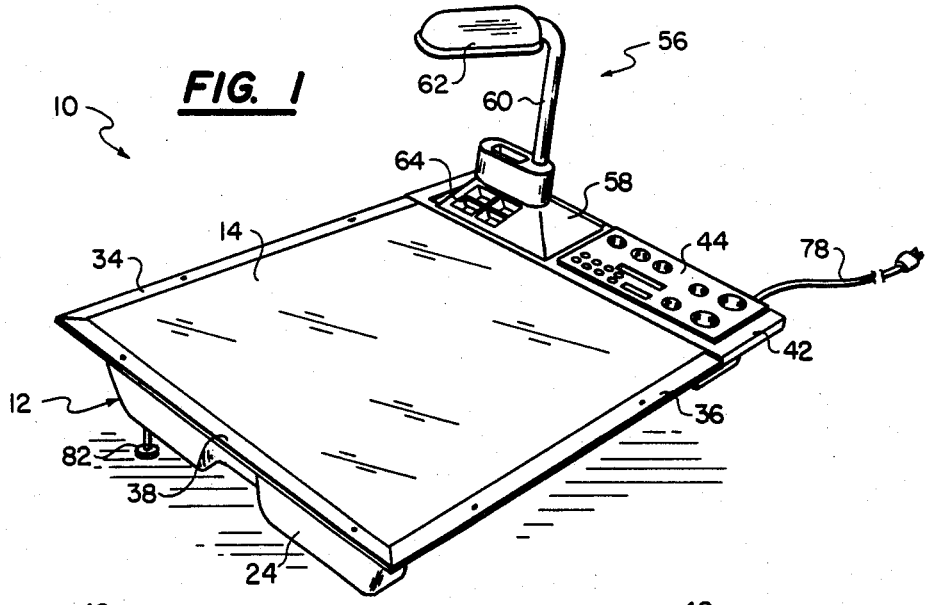
FIG. 1 is a perspective view of a light table in accordance with the invention.

Referring to the drawings, a light table, in accordance with the invention, is illustrated in FIG. 1 setup in position for use. The light table designated generally by the numeral 10 comprises a generally rectangular box-like housing designated generally by the numeral 12 having an open top with a peripheral edge that defines a generally rectangular mounting or support frame. A generally rectangular planar support surface 14 of a transparent material such as glass, a suitable plastic or the like is mounted on the housing 12 and secured thereto. The support surface 14 is preferably of glass to resist scratching. A diffusion sheet 15 is positioned below the support surface sheet 14 for diffusing the light passing through the sheet 14. The diffusion sheet is preferably of a plastic such as that sold under the name Plexiglass. This planar support surface covers the majority of the open top of the housing forming the table top or support surface.

The table, in its preferred configuration, is preferably slightly rectangular in configuration having the longer dimension extending from side to side as can be seen in FIG. 1. The support surface or panel 14 preferably covers approximately eighty percent of the open top of the housing 12 leaving an open area or cavity at one end thereof. This open cavity is preferably at the end of the housing where the electrical cord and connection and controls are disposed.

Figure 3:
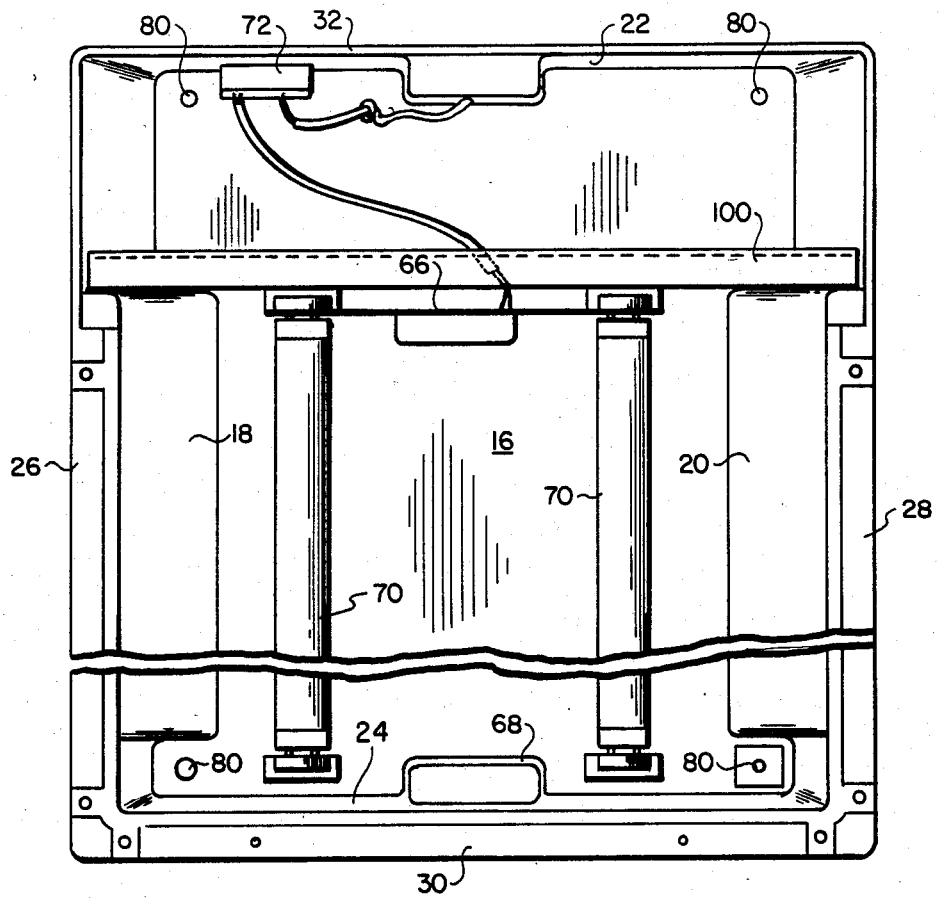
FIG. 3 is a top plan view of the housing portion of the light table of FIG. 1.

The housing, as best seen FIG. 3, is of a generally rectangular box-like construction formed of a unitary body or sheet of plastic material and may, for example, be vacuum formed or otherwise molded into its configuration. As seen in FIG. 3, the housing includes a flat planar bottom 16 of a slightly smaller peripheral dimension than the open top with front and back walls 18 and 20 and side walls 22 and 24 formed integral with the bottom, sloping upward and outward at different angles or degrees from the bottom to a peripheral edge at the top thereof.

Peripheral mounting flanges 26 and 28 are formed by the front and back walls and 30 formed by one side wall. A supporting edge 32 is formed by the upper edge of the other end wall 22 and portions of the front and back walls 18 and 20 adjacent that end of the housing. This forms a housing structure as shown in FIG. 3 having a slightly larger open area at one end thereof in which the tool mounting and support trays will be mounted as described.

Figure 2:
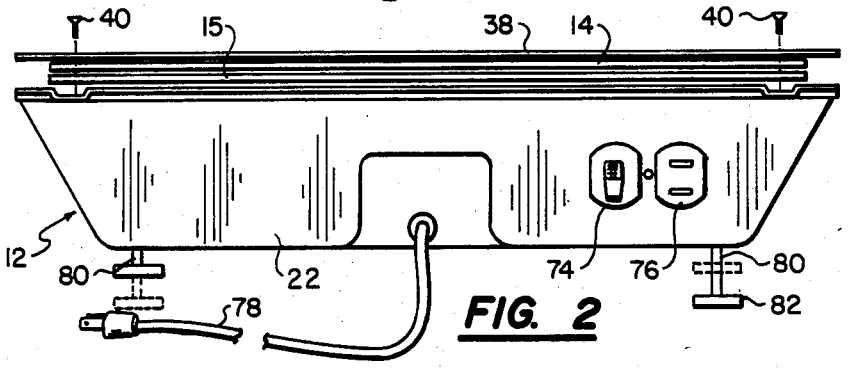
FIG. 2 is an end elevation view of the table of FIG. 1.
Figure 4:
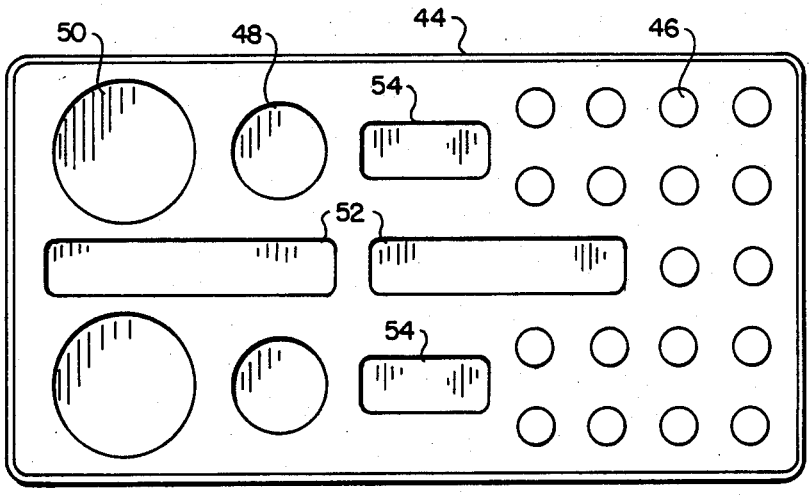
FIG. 4 is a top plan view of one embodiment of a tray for the table of FIG. 1.

As seen in FIG. 2, the planar table top 14 rests directly on the mounting flanges 26–30 and is clamped or secured to the flanges by means of a plurality of molding or retainer strips 34, 36 and 38 as shown in FIGS. 1 and 2. These strips are secured to the housing by means of a plurality of screws or bolts 40 which extend through the strips, the top panel and through holes provided in the housing as shown in FIG. 3. The transparent support panel covers upwards of approximately seventy to eighty percent of the housing leaving an open area or cavity at one end thereof for receiving a first tray 42, which in the preferred form is a plain shallow generally rectangular tray fitting across the entire end of the housing resting on the support edge 32. This tray may be used alone for containing a number of items such as rulers, triangles, line gauges, hand waxers, scissors, etc. A second or alternative tray 44 may fit into this tray and as best seen in FIG. 4 is provided with a plurality of selected cavities for holding artists' and illustrators' tools and implements.

The tray 44, for example, is provided with a plurality of generally cylindrical wells 46 for receiving and holding pencils, pens and similar size and shape tools and instruments. A second size plurality of wells 48 are designed, for example, to hold or mount glue sticks and bottles of white-out or similar tools or supplies. A pair of larger cylindrical wells 50 are designed to hold bottles of ink or the like. A pair or elongated rectangular cavities 52 are designed to hold rolls of tape or similar supplies or the like. A pair of smaller rectangular slots or wells 54 are designed to hold such items are EXACTO (Trademark) blades, linen testers and the like.

As shown in the FIG. 1 embodiment, the tray 44 covers approximately half of the tray 42 and thereby leaves a portion of the tray 42 open for use in holding rulers, triangles, line gauges, etc. In the alternative, a light designated generally by the numeral 56 includes a base 58 designed to fit in the tray 42 and having a neck 60 and light 62 extending over for directing light onto the table. The base of the lamp 58 may also contain receptacles 64 for storage of articles and tools.

Mounted within the housing is a light unit preferably comprising a mounting 66 and 68 for a pair of fluorescent light bulbs 70 with power to the lamp being controlled by a switch unit 72 which may also include a toggle switch 74, as shown in FIG. 2, and one or more electrical outlet sockets 76. Powers to the control box 72 is by way of a conductor cable 78 which may be connected such as by a conventional plug to a suitable source of electrical current.

As can be seen in FIGS. 1–3, the housing is mounted on a plurality of adjustable legs 80 disposed at the four corners of the housing with each comprising a threaded shank which extends into a threaded nut or bore formed or mounted in the housing. Each of the legs includes a foot 82 which may include a rubber or similar pad for engaging a support surface such as a drafting table or the like.

These legs 80 can be adjusted in pairs to tilt the table such that the table may be either right handed or left handed. Thus, the table may be adjusted or the legs thereof adjusted in or out such that the table tilts toward one who is seated at the table with the lamp and storage tray either at the left of the worker or the right, depending on whether he is left or right handed. This places the tray and his instruments, as well as the control switch for the lights and the like, at his right or left hand as desired.

Figure 5:
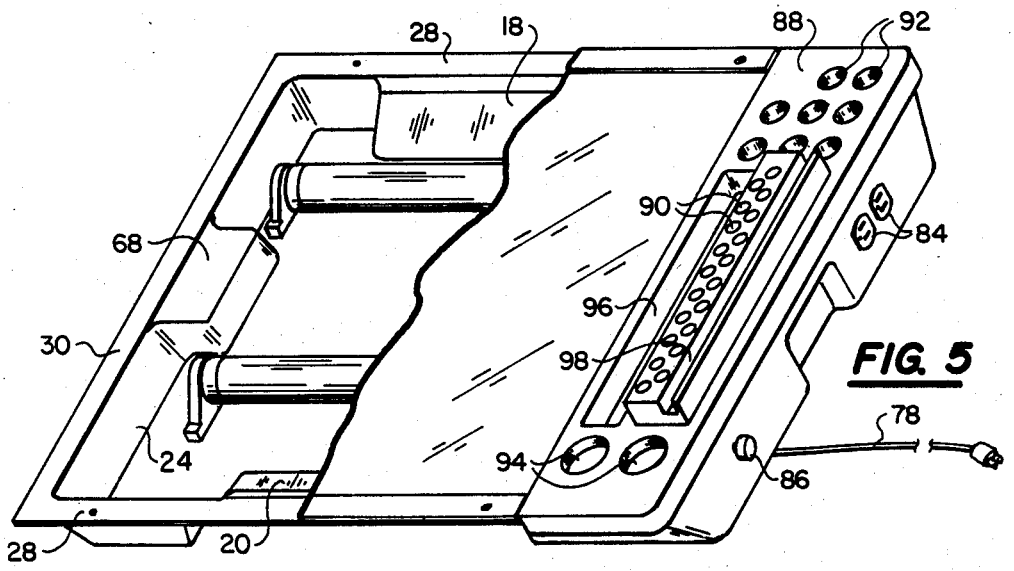
FIG. 5 is a perspective view showing an alternate embodiment of a tray and electrical connection arrangement for the table of FIG. 1.

Referring to FIG. 5, there is illustrated a light table that is an alternate embodiment of that previously described. In this embodiment, the table is provided with two electrical outlets 84 and a light switch 86 separately positioned for the lights within the table. In addition, an alternate embodiment of the storage tray is illustrated at 88 which tray is illustrated to cover the entire area of the previous tray 42. In this embodiment, the tray is provided with a plurality of cylindrical bores 90 on a raised portion thereof for holding pencils, pens, burnishers, EXACTO (Trademark) knives and the like. A plurality of larger cylindrical bores or cavities 92 may be sized to hold such items as glue sticks, large markers and the like. At least a pair of ink wells 94 being formed of cylindrical bores or wells slightly larger than those of 92 are provided for receiving ink bottles. An elongated generally rectangular tray 96 is provided for receiving rulers and similar articles. A groove or slot 98 may be provided for holding and receiving other articles.

The housing is also preferably provided with a support bar 100 as shown in FIG. 3. this bar is preferably L shaped in cross section, and is positioned at the juncture of the table and the tray for supporting the edges of both. A preferred size for the table is about 22×32 inches, with the table support surface being about 21×32 inches. The tray 44 has an inside width of about 6 inches and an outside width of slightly greater than 7 inches. The housing has an inside depth of about 4 inches.

While I have illustrated and described my invention by means of a specific embodiment, it is to be understood that numerous changes and modifications may be made therein without departing from the spirit and scope of the invention as defined in the appended claims.

I claim:

1. A light table and utility holder combination comprising:

a generally rectangular open top housing defining a chamber and a peripheral support frame;

light means mounted within said chamber;

means for connecting said light means to a source of electric power;

a planar transparent support surface for covering the majority of said open top; and a tool holder detachably mounted in one end of said open top of said housing, and comprising a plurality of tool trays;

one of said trays is a rectangular open top tray;

another of said trays is adapted to mount into said one of said trays, and comprises means defining a plurality of tool pockets, and includes a plurality of cylindrical cavities sized for receiving an ink bottle, a plurality of cylindrical cavities sized for receiving pens, pencils, and the like, and at least one rectangular cavity for receiving a roll of tape or the like, and a lamp having a base adapted to fit within one end of said rectangular open top tray.

2. A light table according to claim 1 wherein said another of said trays includes a plurality of cylindrical cavities sized for receiving an ink bottle, a plurality of cylindrical cavities sized for receiving pens, pencils, and the like, and at least one rectangular cavity for receiving a roll of tape or the like.

3. A light table according to claim 1 comprising adjustable legs at the corners of said housing for adjusting the title of said table and for enabling reversal of said table.

4. A light table according to claim 1 wherein said housing is of a unitary molded construction.

5. A light table according to claim 4 wherein said support surface is a sheet of glass, and further comprising a light diffusion sheet disposed below said sheet of glass.

6. The combination of a light table and tool holder comprising:

a generally rectangular open top box-like housing formed of a unitary molded construction defining a cavity and a peripheral support flange;

a planar transparent support panel covering from about sixty to eighty percent of said open top for defining a work surface detachably attached to said support flange;

a light unit mounted within said chamber for directing light through said transparent panel;

a tool holder for holding a plurality of different tools detachably mounted at and extending along one side of said open top housing adjacent said work surface within said cavity for positioning tools at one side of said work surface; and adjustable legs on said housing for adjusting the slope of said table surface and for enabling reversal of said table for positioning the tool tray selectively on the right or the left of the user of light table.

7. A combination according to claim 6 wherein said tool holder comprises a first shallow open top tray extending along said one side of said table and a second tray having a plurality of tool pockets mounted in said first tray.

8. A combination according to claim 7 wherein said work surface is defined by a sheet of glass, and further comprising a diffusion sheet disposed between said sheet of glass and said light.

9. A light table and utility holder combination comprising:

a generally rectangular open top housing formed of a unitary molded construction defining a cavity and a peripheral support frame;

light means mounted within said cavity;

means for connecting said light means to a source of electric power;

a planar transparent support surface for covering from about sixty percent to about eighty percent of the open top of said housing detachably; and a tool holder comprising a plurality of tool trays detachably mounted in and extending along one side of said open top of said housing within said cavity and covering the remainder of said open top.

10. A light table according to claim 9 wherein:

one of said trays is a rectangular open top tray; and another of said trays comprises means defining a plurality of tool pockets.

11. A light table according to claim 10 wherein:

said another of said trays is adapted to mount into said one of said trays.

* * * * *